United States Patent [19]

Franke

[11] 4,214,386

[45] Jul. 29, 1980

[54] BUCKET WHEEL EXCAVATOR WITH VIBRATING BUCKETS

[75] Inventor: Rüdiger Franke, Mettmann, Fed. Rep. of Germany

[73] Assignee: DEMAG Aktiengesellschaft, Duisburg, Fed. Rep. of Germany

[21] Appl. No.: 10,314

[22] Filed: Feb. 7, 1979

[30] Foreign Application Priority Data

Feb. 9, 1978 [DE] Fed. Rep. of Germany ..... 2805389

[51] Int. Cl.[2] ..... E02F 3/24

[52] U.S. Cl. ..... 37/190; 37/DIG. 18; 198/509; 198/631; 198/703; 299/14; 299/67

[58] Field of Search ..... 37/DIG. 18, 189, 190; 198/307, 509, 631, 703; 299/14, 67, 45

[56] References Cited

FOREIGN PATENT DOCUMENTS 705967 5/1941 Fed. Rep. of Germany .... 37/DIG. 18

279459 11/1970 U.S.S.R. ..... 37/DIG. 18

*Primary Examiner*—Clifford D. Crowder

*Attorney, Agent, or Firm*—Mandeville and Schweitzer

[57] ABSTRACT

A bucket wheel type excavator is provided in which a vibrating movement is imparted to the individual cutting components of each bucket on the wheel. Moreover, each such imparting movement to the individual teeth or cutting components is from a single excitation device fixed in the axis of the wheel and driven from a power source coaxially through a hollow shaft for the wheel. The imparting movement is through flexible bars extending from the excitation device to a point adjacent the cutting components wherein the vibrating end of the respective flexible bar is spaced from and intermittently vibrates the cutting component which, in turn, is pivotally mounted.

8 Claims, 5 Drawing Figures

BUCKET WHEEL EXCAVATOR WITH VIBRATING BUCKETS

BACKGROUND AND DESCRIPTION OF THE INVENTION

The present invention refers to a bucket wheel for bucket wheel excavators or similar pick-up apparatus, where the regular peripheral speed is overlayed with an oscillating additional motion at the buckets. The forces required for cutting and drilling processes, such as occurring in mining extraction apparatus or in excavating machinery, can, in some instances, be favorably influenced by deliberately imposing upon the regular cutting motion with an irregular parallel additional motion. It is, for example, known to utilize so-called coal planers in mining operations where the regular cutting speed is produced by a pulley at the end of the mining line, and an additional motion in cutting direction which results from excitation of the planar body bearing the cutting tools by means of a system of revolving masses.

Such a system is relatively accessible to theoretical considerations, and it follows that the required tensile forces which are a direct measure for the cutting forces, decrease substantially while chip thickness remains constant. Theories are fully confirmed by the results of tests utilizing near-practical applications.

It is also known to apply this effective principle for bucket wheel excavators in loosening rocks, coal, or harder mineral deposits, as shown in German Publication No. 13 02 187. There, the entire bucket wheel revolving at constant peripheral speed receives an overlayed motion in peripheral direction by means of vibration or percussion devices. Such an apparatus, where the entire wheel body has to be accelerated or decelerated in order to achieve additional motion, requires such great driving powers that it is prohibitive in practice. Furthermore, it is known to have the additional motion in excavators, which operate with one single bucket, executed merely through the cutting teeth or cutting edges at the digging tools, e.g. by arranging hydraulic or pneumatical cylinders for immediate movement of the cutting elements in the top or side walls of the buckets.

It is easy to see that the use of this type apparatus in a bucket wheel excavator, which is equipped with eight or more buckets, and where the drive from the stationary apparatus would have to be transmitted to the rotating bucket wheel, would be too complicated and involved. Furthermore, the buckets of continuously operating multi-bucket excavators offer, in comparison to discontinuously operating single-bucket excavators of identical mining capacity, substantially less space to accommodate motive devices in the bucket itself.

Based on the prior art as known from German Patent Publication No. 13 02 187, the present invention is a bucket wheel for bucket wheel excavators to loosen and pick up rock, coal or harder mineral deposits, which provides activated cutting elements to loosen the material, which offers optimum output with little requirement of energy, which is light weight, with few additional components, and which does not hinder the material flow for the mined bulk goods, and which is arranged in a fashion requiring little maintenance and repair.

To solve this problem, a bucket wheel is provided which is distinguished by a vibrator arranged in the center of the bucket wheel, from where the vibratory energy is transmitted via bars coordinated with each bucket onto the cutting elements capable of vibration in the buckets. Preferably, the bars are designed as flexible bars which rest on the bucket wheel in two spaced bearing points at a distance from the bar ends, whereby one end of the bar is connected to the vibrator, and the other end of the bar vibrates freely and engages the cutting element.

The invention is based on the thought that, by placing the origin of the vibration in the center of the bucket wheel, and connecting the vibrators with several flexible bars representing a spring-mass system to transmit the vibrators to the location of the cutting motions, a simple means of transmitting the driving power is provided. According to another detail of the invention, it is then possible to have the vibrator driven through the hollow shaft of the cantilevered bucket wheel.

The invention is further based on the realization that the flexible bars which are excited near their resonance frequency, require very little energy to maintain the vibration, since only part of the buckets, with reference to the rotational path of the bucket wheel, is engaged with the mining material, whereby energy is drawn from the vibrational system only at those buckets which are engaged. The remaining vibrating flexible bars only represent an energy storage. According to a preferred feature of the invention, the vibrator consists of an unbalance exciter. Several vibration exciters may be coupled together and connected to one common drive. The flexible bars of the apparatus of this invention may be turned to that frequency which is likely to break up the material to be mined by altering the cross sectional values, by altering the bearing points, or by setting up additional masses in their natural frequency (e.g. 100 Hz).

The invention provides that the cutters of each bucket are arranged in a manner permitting vibration, and are chargeable by the vibrating flexible bars. The movements of the ends of the flexible bars are transmitted to the cutting edge separated from the bucket by contact while the cutting edges in turn are engaged with the material to be picked up. The advantages that any wear, and thus change in the relationship of the masses at the cutter, has no influence on the natural vibrational frequency of the flexible bars. After extreme wear, the cutters may easily be changed. Another detail of the invention includes providing additional cutting means corresponding to the buckets, which are chargeable by the flexible bars.

It is of particular advantage if only those cutting elements which are engaged with the material to be picked up, are charged by the flexible bars. Preferably, provision is made to keep away from the vibrating ends of the flexible bars those cutting elements which are not engaged in order to avoid the effects of spring elements. This also results in considerable noise reduction.

The scope of the invention also provides that between vibrators and the flexible bars transmitting the vibrating energy to the cutting elements, strain-stress bars are arranged which couple these parts in spaced apart fashion. Especially suitable for the use of the apparatus described by the invention are so-called half-cell wheels.

The invention represents a simple vibrational system which may be readily conformed to theoretical calculation, whereby it is possible, with low energy requirements, to transmit the driving power in a simple fashion from the stationary cantilevered arm or beam of the apparatus to the revolving bucket wheel, whereby the material flow of the mined material in the bucket wheel is not hindered by additional structural elements not being part of a normal bucket wheel, thus guaranteeing easy access to all structural parts for maintenance and repair. Furthermore, the invention has the advantage of providing a vibrational system which does not change its characteristics by possible alteration of the effective masses due to the often considerable wear of the cutting elements, and which solves the problem at hand with few additional structural parts, having a favorable effect on the light weight of the apparatus.

An example of the invention is shown on the drawings as follows.

DETAILED DESCRIPTION OF THE INVENTION

Figure 1:
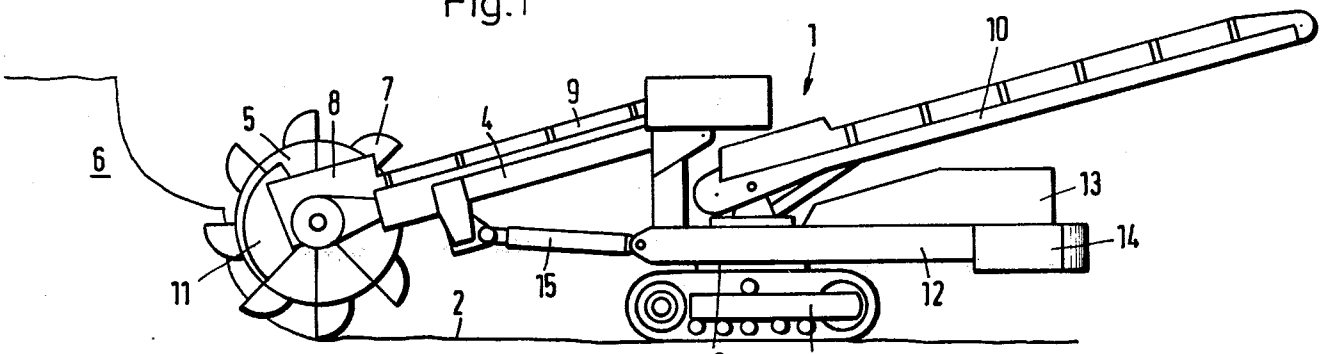
FIG. 1 is a somewhat diagrammatic side elevational view of apparatus embodying the invention.

1 designates the apparatus in FIG. 1, moving on plane 2 by means of a endless crawler undercarriage 3. At the front end of apparatus 1 a cantilevered beam 4 is hinged to be raised or lowered by means of the piston-cylinder unit 15, and bearing at its free end bucket wheel 5, which picks up the material 6. Buckets 7, after picking up the material 6, transport the latter along the chute 11 to the upper area of bucket wheel 5, from where it is brought to the conveyor belt 9 on beam 4 via a lateral chute 8. From there, the material drops onto the conveyor on cantilevered beam 10, and then goes on to a removal device which is not shown here.

Figure 2:
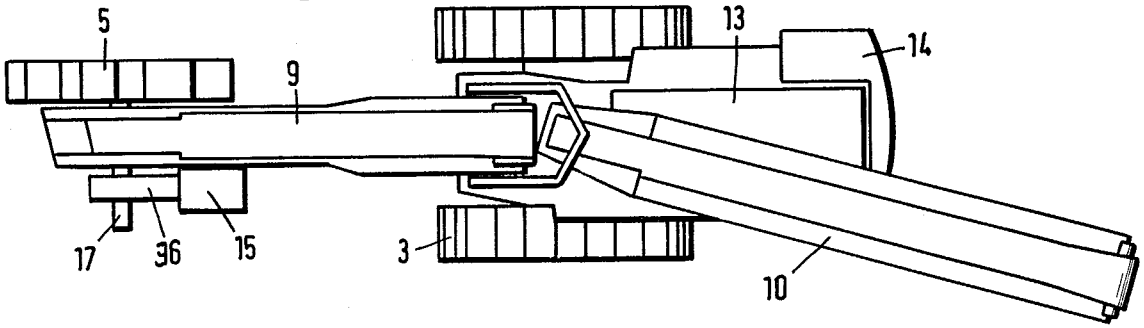
FIG. 2 is a top plan view of the apparatus of FIG. 1.

The entire apparatus pivots on undercarriage 3 around pivot 16. 12 designates the revolving turntable bearing at its rear end counter-weight 14, as well as motor compartment 13. In FIG. 2 the same numbers stand for the same parts. 15 is the drive for the bucket wheel, and gear 36 is arranged between drive 15 and bucket wheel 5. The drive for the rotary vibrator, as described for the invention is shown at 17. It is coupled to gear 36 for the bucket wheel shaft coaxially.

Figure 4:
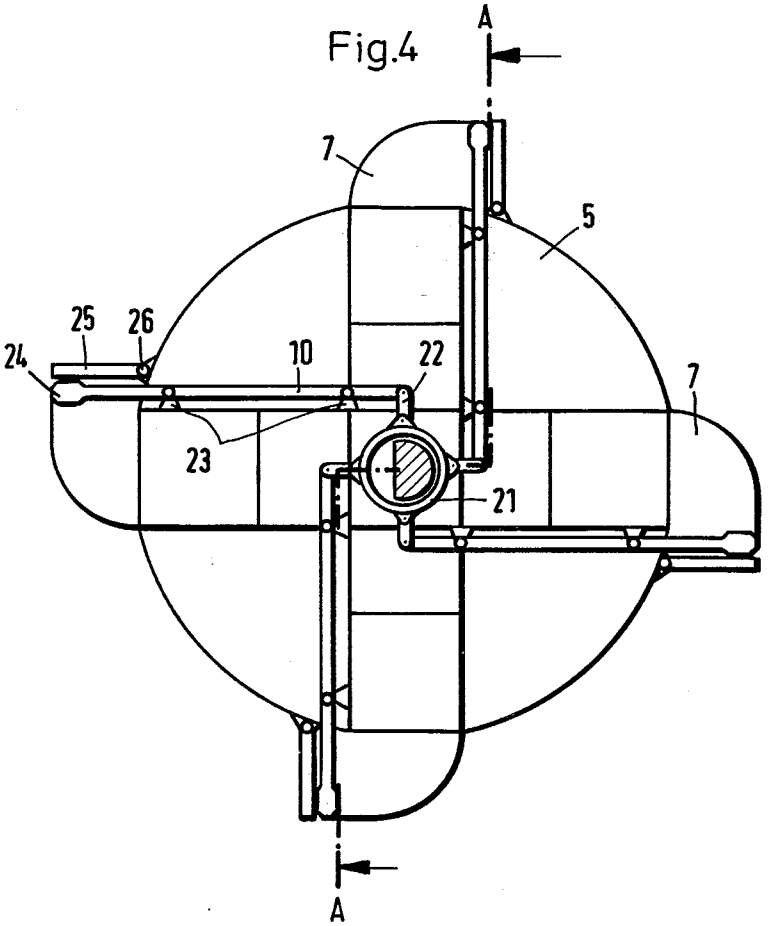
FIG. 4 is an enlarged side elevational view of the bucket wheel of the invention.
Figure 3:
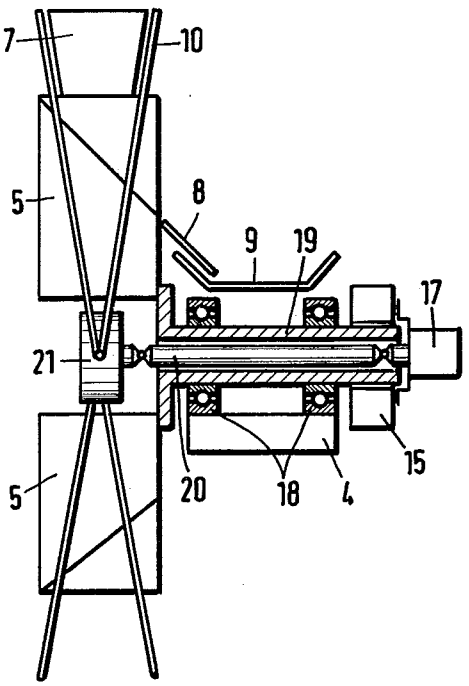
FIG. 3 is a cross sectional view taken along lines A—A of FIG. 4.

In FIG. 3, too, like parts have like numbers. Furthermore, it is shown that bucket wheel 5 is arranged on cantilevered beam 4 in cantilever fashion at 18, whereby a hollow shaft 19 is utilized. A universal-joint shaft 20 leads through the hollow shaft 19 connecting rotary vibrator 21, which may be an unbalanced exciter, with drive 17. The rotary vibrator 21, in turn, is coupled with the flexible bars 10 which lead to the periphery of the bucket wheel 5 in the area of the buckets 7. FIG. 4 shows that the flexible bars 10 are connected with the rotary vibrator 21 by means of strain-stress bars 22, which couple both parts while allowing spacing between. The flexible bars 10 have a dual bearing at 23, and the free ends of the flexible bars 10 are thickened at 24 and vibrate freely.

The cutters 25 of buckets 7 are linked at 26 to a swivel pin parallel with the bucket wheel axis. The thickened end of flexible bars 10 is spaced so slightly from cutter 25 that the latter can be set in vibration as well when touched by the vibrating bars.

Figure 5:
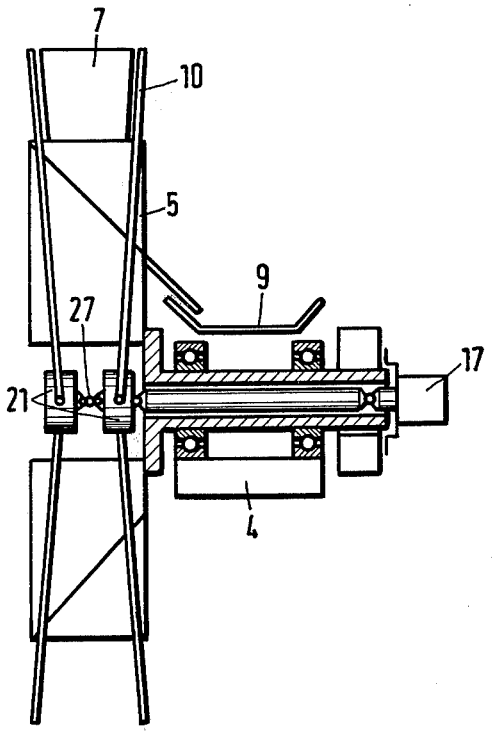
FIG. 5 is a cross sectional view similar to FIG. 3, but showing an embodiment of the invention in which two excitation devices are used.

FIG. 5 shows a cross section of a bucket wheel in accordance with the invention using two vibrators 21 which are successively arranged at 27 and coupled with each other. Otherwise, the example in FIG. 5 does not differ from that in FIG. 3.

The mode of operation of the bucket wheel according to the invention is that drive 17 starts vibrations in the rotary vibrator 21 via universal-joint shaft 20, with such vibrations being transmitted to the flexible bars 10 by means of strain-stress bars 22. Due to the bearing of the flexible bars 10 at 23 the latter vibrate in such a fashion that the free ends 24 knock against cutters 25, which are spaced at a slight distance from the former, so that cutters 25 also execute an oscillating motion. The bearing points 23 of the flexible bars 10 may be moved in order to allow for adjustment of the vibrational frequency.

I claim:

1. Apparatus for mining and excavating, comprising
(a) a support;
(b) a bucket wheel rotatable on said support;
(c) power means on said support for rotating said bucket wheel;
(d) a plurality of circumferentially spaced excavating buckets on said wheel;
(e) cutting elements pivotally positioned in each said bucket; the improvement characterized by
(f) vibrating means disposed in the axis of said bucket wheel;
(g) a plurality of vibrator bars on said wheel; and
(h) each said bar extending between said vibrating means and one of said cutting elements;
(i) whereby the vibrating energy from said vibrating means is transmitted over said bars to each of said cutting elements.

2. The apparatus of claim 1, further characterized by
(a) each said bar is flexible;
(b) each said bar rests on two spaced bearing points spaced from the ends of said bars;
(c) one end of each said bar is connected to said vibrating means; and
(d) the end of each said bar adjacent its respective cutting element being spaced slightly therefrom to alternately engage and disengage from said cutting element.

3. The apparatus of claim 2, further characterized by
(a) a hollow drive shaft for said rotatable bucket wheel; and
(b) power means for vibrating said vibrating means extending through said hollow shaft.

4. The apparatus of claim 3, further characterized by
(a) said vibrating means includes an eccentric.

5. The apparatus of claim 4, further characterized by
(a) a plurality of connected together vibrating means positioned coaxially in the axis of said bucket wheel.

6. The apparatus of claim 5, further characterized by
(a) the said pivot mounting of each said cutting element is such that said vibrating bars do not engage them except when they engage the material to be picked up.

7. The apparatus of claim 6, further characterized by
(a) strain stress bars connecting each said flexible bar with said vibrating means in spaced relation.

8. The apparatus of claim 7, further characterized by
(a) the pivotal mounting of each said element is such that said cutting elements pivot out of engagement with said vibrator bars when not engaging material to be cut.

* * * * *